US012540518B2

(12) United States Patent
Clarke

(10) Patent No.: US 12,540,518 B2
(45) Date of Patent: Feb. 3, 2026

(54) CONTROLLING DRILLING FLUID COMPOSITION USING AN INVERTED MULTI-VARIABLE DRILLING FLUID ADDITIVE MODEL

(71) Applicant: Schlumberger Technology Corporation, Sugar Land, TX (US)

(72) Inventor: Andrew Clarke, Haslingfield (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 959 days.

(21) Appl. No.: 17/587,057

(22) Filed: Jan. 28, 2022

(65) Prior Publication Data

US 2022/0243544 A1 Aug. 4, 2022

Related U.S. Application Data

(60) Provisional application No. 63/199,883, filed on Jan. 29, 2021.

(51) Int. Cl.
*E21B 21/06* (2006.01)

(52) U.S. Cl.
CPC ..... *E21B 21/062* (2013.01); *E21B 2200/20* (2020.05)

(58) Field of Classification Search
CPC ..... E21B 21/062; E21B 2200/20
USPC ..... 703/9
See application file for complete search history.

(56) References Cited

U.S. PATENT DOCUMENTS

| | | | | |
|---|---|---|---|---|
| 6,176,323 | B1 * | 1/2001 | Weirich | E21B 44/005 175/40 |
| 6,926,101 | B2 * | 8/2005 | deBoer | E21B 33/076 175/70 |
| 7,594,541 | B2 | 9/2009 | Ciglenec et al. | |
| 8,117,016 | B2 | 2/2012 | Halabe et al. | |
| 9,194,972 | B2 * | 11/2015 | Van Der Zwaag | G01V 3/32 |
| 9,482,084 | B2 * | 11/2016 | Chang | E21B 44/00 |
| 9,567,852 | B2 * | 2/2017 | Jamison | E21B 49/08 |
| 9,696,193 | B2 * | 7/2017 | Martin | E21B 47/10 |
| 9,874,506 | B2 * | 1/2018 | Gao | E21B 49/081 |
| 10,513,648 | B2 * | 12/2019 | Amanullah | C09K 8/06 |

(Continued)

FOREIGN PATENT DOCUMENTS

| | | | |
|---|---|---|---|
| GB | 2582841 A * | 10/2020 | E21B 44/00 |
| RU | 2837662 C2 * | 4/2025 | |

OTHER PUBLICATIONS

Abubakar et al. ("2.5D forward and inverse modeling for interpreting low-frequency electromagnetic measurements", Geophysics ,vol. 73, No. 4 Jul.-Aug. 2008; p. F165-F177) (Year: 2008).*

(Continued)

*Primary Examiner* — Iftekhar A Khan
(74) *Attorney, Agent, or Firm* — Jeffrey D. Frantz

(57) ABSTRACT

A drilling fluid manager creates a multi-dimensional drilling fluid additive model and interpolates changes in a drilling fluid based on a combination of additives. The interpolations are inverted to determine the amount of additives based on measurements of drilling fluid properties. As fluid is returned to the surface, drilling fluid parameters are measured. A difference between the measured fluid parameters and setpoint fluid properties and the inverted interpolations are used to determine the amounts of each additive.

17 Claims, 7 Drawing Sheets

(56) References Cited

U.S. PATENT DOCUMENTS

| | | | | |
|---|---|---|---|---|
| 10,612,374 | B2 * | 4/2020 | Kleinguetl | E21B 49/088 |
| 10,891,573 | B2 | 1/2021 | Foubert et al. | |
| 10,901,377 | B2 * | 1/2021 | Dykstra | G05B 13/042 |
| 10,934,835 | B2 * | 3/2021 | Deville | E21B 47/11 |
| 11,118,446 | B2 * | 9/2021 | Shang | E21B 33/06 |
| 2003/0029640 | A1 * | 2/2003 | Cooper | G01N 11/08 166/250.01 |
| 2004/0016572 | A1 * | 1/2004 | Wylie | E21B 21/062 175/207 |
| 2009/0152007 | A1 * | 6/2009 | Judzis | E21B 21/01 175/207 |
| 2009/0194330 | A1 * | 8/2009 | Gray | E21B 21/062 175/48 |
| 2011/0125333 | A1 * | 5/2011 | Gray | E21B 21/08 175/48 |
| 2011/0246161 | A1 * | 10/2011 | Morton | E21B 49/00 703/9 |
| 2014/0041941 | A1 * | 2/2014 | Edbury | E21B 7/06 175/24 |
| 2014/0121975 | A1 * | 5/2014 | Acharya | E21B 7/00 702/9 |
| 2014/0326449 | A1 * | 11/2014 | Samuel | E21B 41/00 340/853.3 |
| 2015/0024976 | A1 * | 1/2015 | Albrighton | C09K 8/601 703/2 |
| 2015/0129306 | A1 * | 5/2015 | Coffman | E21B 44/00 175/48 |
| 2017/0343969 | A1 * | 11/2017 | Dykstra | E21B 44/005 |
| 2018/0039900 | A1 * | 2/2018 | Hoeink | E21B 25/005 |
| 2018/0210413 | A1 * | 7/2018 | Frangos | G06N 7/01 |
| 2018/0238164 | A1 | 8/2018 | Jamison et al. | |
| 2019/0055797 | A1 * | 2/2019 | Astrid | E21B 21/08 |
| 2019/0219558 | A1 * | 7/2019 | Villar De Andrade E Silva | G01N 33/2823 |
| 2020/0102799 | A1 * | 4/2020 | Fischer | B01F 35/213 |
| 2020/0256180 | A1 * | 8/2020 | Cuellar | E21B 44/00 |
| 2020/0291776 | A1 * | 9/2020 | Han | G01N 29/4472 |
| 2020/0362694 | A1 * | 11/2020 | Al-Rubaii | E21B 21/08 |
| 2020/0362695 | A1 * | 11/2020 | Al-Rubaii | E21B 49/005 |
| 2021/0054737 | A1 * | 2/2021 | Dai | E21B 49/081 |
| 2021/0332683 | A1 * | 10/2021 | Hunter | E21B 43/261 |
| 2022/0243544 | A1 * | 8/2022 | Clarke | E21B 44/00 |
| 2022/0275695 | A1 * | 9/2022 | Haughs | E21B 21/08 |
| 2022/0403721 | A1 * | 12/2022 | Jaaskelainen | E21B 47/114 |
| 2023/0175393 | A1 * | 6/2023 | Kulkarni | G01N 33/2823 73/152.04 |

OTHER PUBLICATIONS

Pal, R., "Single-Parameter and Two-Parameter Rheological Equations of State for Nondilute Emulsions", Ind. Eng. Chem. Res. 2001, 40, 23, pp. 5666-5674.

"Functions of drilling fluid," Jun. 25, 2015, Retrieved from: https://petrowiki.spe.org/Functions_of_drilling_fluid.

Radhakrishan, R., Divoux, T., Manneville, S., and Fielding, S. M., Soft Matter, 2017, 13, pp. 1834-1852.

Wikipedia, "Design of experiments", retrieved from https://en.wikipedia.org/wiki/Design_of_experiments, last updated Jan. 27, 2022, 5 pages.

Wikipedia, "Monte Carlo method", retrieved from https://en.wikipedia.org/wiki/Monte_Carlo_method, last updated Jan. 19, 2022, 9 pages.

American Petroleum Institute, API standard 13B, "Recommended Practice Standard Procedure for Field Testing Drilling Fluids," 1989, 59 pages.

* cited by examiner

CONTROLLING DRILLING FLUID COMPOSITION USING AN INVERTED MULTI-VARIABLE DRILLING FLUID ADDITIVE MODEL

CROSS-REFERENCE TO RELATED APPLICATIONS

This application claims the benefit of, and priority to, U.S. Patent Application No. 63/199,883, filed Jan. 29, 2021 and titled "Method to Control Drilling Fluid Properties in Real Time". This application is also related to a U.S. Patent Application filed concurrently herewith and titled "Systems and Methods for Managing and Optimizing Drilling Fluid Properties". Each of the foregoing applications is expressly incorporated herein by this reference in its entirety.

BACKGROUND

Downhole drilling often involves degrading a formation by rotating a drill bit against a formation at the bottom of a wellbore. Drilling fluid, or drilling mud, is often circulated through the wellbore from a mud pit on the surface to the drill bit. The drilling fluid may cool the drill bit, collect the cuttings generated by the drill bit, and carry the cuttings to the surface. The formula of a drilling fluid is often engineered to have particular properties, such as shear strength, density, viscosity, and so forth. These properties relate to the drilling effectiveness drilling operation. As the drilling fluid collects the cuttings and interacts with the formation, the properties of the drilling fluid may be altered. Changing the properties of the drilling fluid may result in a reduced effectiveness of the drilling operation, which may result in damage to the downhole drilling assembly.

Conventionally, as the drilling fluid circulates back to the surface, a drilling fluid engineer may provide additives to the drilling fluid to maintain its desired properties. The drilling fluid engineer typically directly manages analysis of the properties of the returned fluid. The drilling fluid engineer then uses a combination of trial and error and his or her extensive experience in drilling fluid management to determine the type and amount of additives to add to the drilling fluid. This process is imprecise and expensive, and may result in decreased effectiveness of the drilling operation and increased drilling fluid costs. In particular, the drilling engineer may have multiple additives to change the drilling fluid properties. Each of the additives may change multiple properties, and a combination of additives and additive quantities may have unpredictable consequences on the drilling fluid properties.

SUMMARY

In some embodiments, a method for managing a drilling fluid includes receiving interpolations of an effect on one or more drilling fluid properties based on adding a plurality of additives to a drilling fluid. A measurement of a plurality of drilling fluid parameters are received and a difference in the measurement from predetermined setpoint fluid properties is determined. The amount of the plurality of additives used to return the drilling fluid parameters to within a threshold of the predetermined setpoint fluid properties based on the interpolation and the difference is determined.

In some embodiments, a method for managing a drilling fluid composition includes creating a multi-dimensional drilling additive model of an effect of a plurality of additives on drilling fluid properties. The multi-dimensional drilling additive model is inverted. A plurality of fluid parameters are measured and a difference between the measured fluid parameters and setpoint fluid properties is determined. Based on the difference and the inverted multi-dimensional drilling additive model, an additive amount for each of the plurality of additives is determined.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
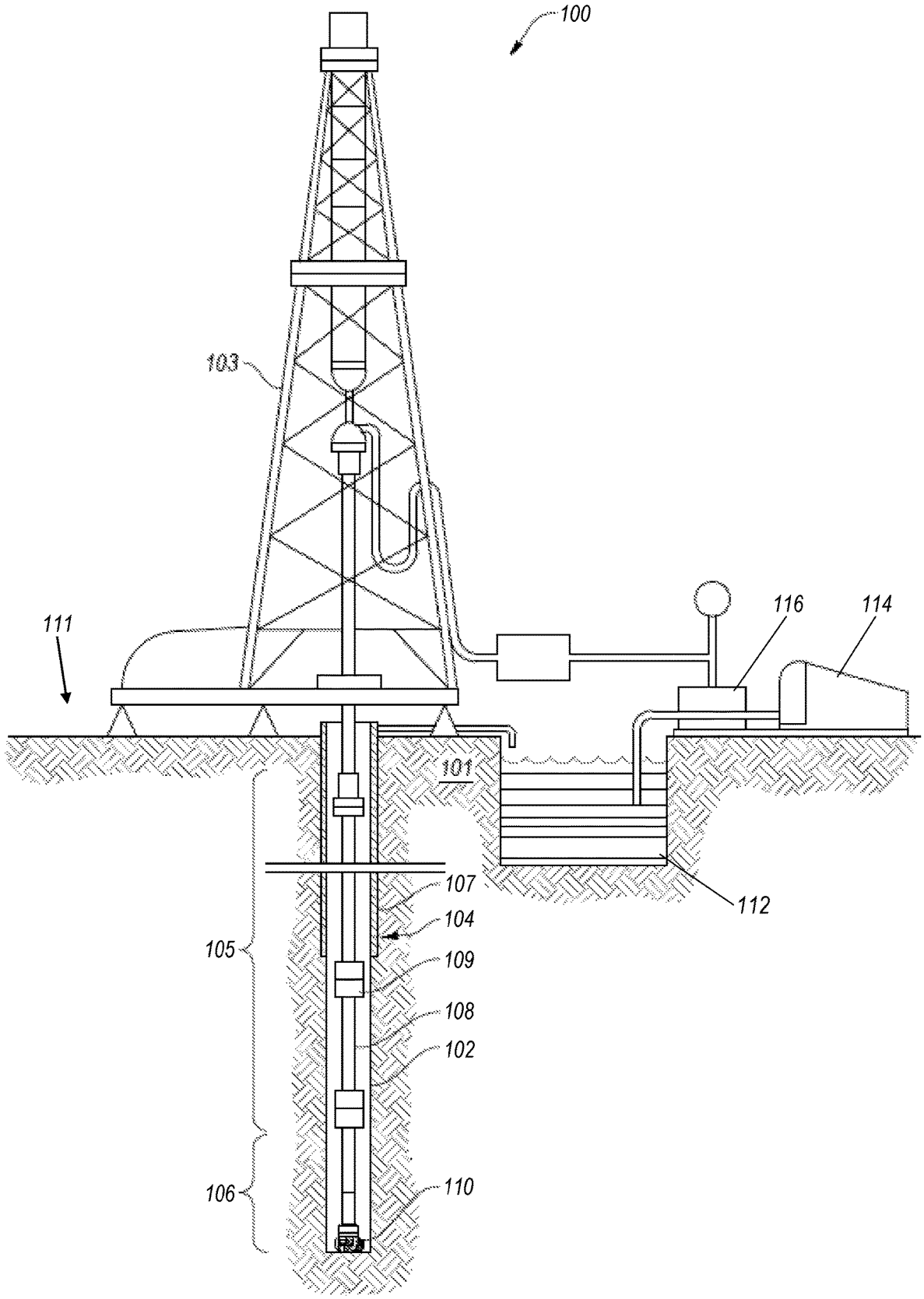
FIG. 1 is a representation of a drilling system, according to at least one embodiment of the present disclosure.

This disclosure generally relates to devices, systems, and methods for managing the fluid properties of a drilling fluid using while drilling a wellbore. A drilling fluid manager generates or receives a multi-dimensional drilling additive model. The multi-dimensional drilling additive model correlates the addition of various drilling additives and combinations of additives and how they affect the properties of the drilling fluid. This generates an interpolation of a drilling fluid property as a function of the various drilling fluid additives. The interpolation function may then be inverted to result in the component additive as a function of drilling fluid properties. Given a fluid property setpoint and a measured difference between a measured drilling fluid parameter and the fluid property setpoint, the inverted function may be optimized to determine the quantities of each additive to add to the returned drilling fluid.

In accordance with one or more embodiments of the present disclosure, the multi-dimensional drilling additive model may have a number of variables that is equal to the number of drilling additives. To provide a quantity of each additive from the inverted model, the drilling fluid manager may receive or collect a number of unique measurements that are equal to or greater than the number of drilling additives. The optimization function may further include one or more constraints, such as cost or available quantity of each additive, that may help to further define the quantities of additives to use.

In some embodiments, the drilling fluid manager may determine additive quantities throughout the drilling process. For example, as drilling fluid is returned to the surface, the drilling fluid manager may receive and/or collect measurements of the returned drilling fluid. When the measured drilling fluid parameters are out of a threshold of the setpoint drilling fluid properties, then the drilling fluid manager may use the collected measurements to determine the amount of additives to add to the drilling fluid. After the returned drilling fluid is mixed with the additives, the re-mixed drilling fluid may be circulated through the wellbore. When the re-mixed drilling fluid returns to the surface, the drilling fluid manager may determine another quantity of additives, mix them in the drilling fluid, and re-circulated through the wellbore. In this manner, the drilling fluid manager may help to maintain the properties of the drilling fluid. This may help to improve the accuracy of the quantity of each additive compared to conventional systems. Improving the accuracy of each additive may improve drilling effectiveness and/or reduce the cost of drilling operations.

In accordance with embodiments of the present disclosure, the drilling fluid manager may not know the original formulation of the drilling fluid. In this manner, the drilling fluid manager may be used across multiple wellbores that utilize the same combination of additives, despite different wellbores having different original formulations and/or different fluid property setpoints. This may help to further improve the cost-effectiveness of the drilling system.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly (BHA) 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled. The drilling fluid may be engineered with particular drilling fluid properties to facilitate cooling the bit 110, the cutting structures thereon, lifting cuttings out of the wellbore, supporting the walls of the wellbore, and so forth.

The drilling fluid may be stored in a mud pit 112 at a surface location 111. Drilling fluid may be drawn from the mud pit 112 and pumped into the drill string 105 using one or more mud pumps 114. As the drilling fluid flows out of the drill string 105, such as through the bit 110 or other location, the drilling fluid may carry cuttings, swarf, or other material out of the wellbore 102. The cuttings, swarf, and other material may cause a change to the properties of the drilling fluid, such as a change in density, shear stress, viscosity, and so forth. When the drilling fluid is returned to the surface location 111, such as to the mud pit 112, the properties of the drilling may be changed by the introduction of contaminants from the wellbore 102.

A measurement station 116 or sensor station may measure the parameters of the drilling fluid. The drilling fluid may have setpoint fluid properties. In some embodiments, when the measured parameters of the drilling fluid have deviated from the setpoint fluid properties by more than a threshold amount, then the drilling fluid may be less effective at cooling the bit 110, the cutting structures thereon, lifting cuttings out of the wellbore, supporting the walls of the wellbore, and so forth. Conventionally, as discussed herein, when the measured parameters deviate from the setpoint fluid properties, a drilling fluid engineer may add one or more additives to the drilling fluid. For example, the drilling fluid engineer may add the additives to the drilling fluid in the mud pit 112 and mix the drilling fluid and the additives.

The measurement station 116 may measure the parameters of the re-mixed drilling fluid and compare them to the setpoint fluid properties. Using the measured parameters, the drilling fluid engineer may continue to add additives until the measured parameters are within the setpoint fluid properties. This process is effectively trial and error, tempered by the experience of the drilling fluid engineer. Indeed, given multiple different additives and multiple setpoint fluid properties, a drilling fluid engineer cannot determine the optimum combination of amounts of additives to return the drilling fluid to the setpoint fluid properties.

In accordance with one or more embodiments of the present disclosure, a drilling fluid manager may calculate the combination of amounts of additives to return the drilling fluid to the setpoint fluid properties. The drilling fluid manager may receive a multi-dimensional drilling fluid additive model (or as used herein, additive model). As discussed herein, the additive model may include interpolations of the effect of the addition of the additives on the various drilling fluid properties. The drilling fluid manager may invert the additive model and, using the measured fluid parameters, solve the inverted model for the amounts of each of the additives used to return the drilling fluid parameters of the returned drilling fluid to the setpoint fluid properties. In some embodiments, the drilling fluid manager may optimize the solution using one or more optimization functions, such as a Monte Carlo simulation or steepest descent method. In this manner, the drilling fluid manager may help to accurately and efficiently determine the amount of the additives to add to the drilling fluid. Indeed, the drilling fluid manager may more accurately and/or more efficiently determine the amounts of additives when compared to existing or conventional systems.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
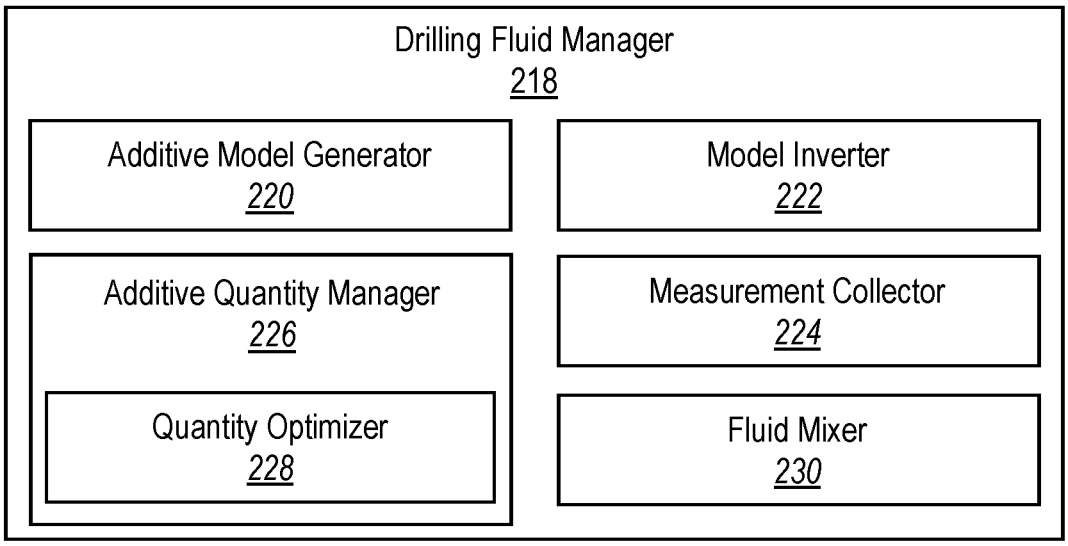
FIG. 2 is a representation of a drilling fluid manager, according to at least one embodiment of the present disclosure.

FIG. 2 is a representation of a drilling fluid manager 218, according to at least one embodiment of the present disclosure. The drilling fluid manager 218 may determine the amounts of additives to add to the drilling fluid to return the drilling fluid to the setpoint fluid parameters. In some embodiments, the drilling fluid manager may include an additive model generator 220. The additive model generator 220 may generate a multi-dimensional drilling additive model. For example, in some embodiments, the additive model generator 220 may utilize a design of experiment (DoE) matrix to develop the additive model.

The DoE methodology utilizes statistical methods to determine correlations, including non-linear relationships and synergistic interactions, between multiple variables of a data set. Using DoE, the number of experiments to model the behavior of a particular multi-variable dataset may be significantly reduced. For example, a drilling system may have 5 additives. In some embodiments, one or more of the additives may include a single compound or product. In some embodiments, one or more of the additives may include multiple compounds or products that are pre-mixed and utilized as a single additive. To fully model the drilling system, a prohibitively large number of experiments may be used. For example, for a drilling system having four levels of five tanks of additives, a total of 1,024 sample experiments may be performed (e.g., $4^5$). This may be too time intensive and/or expensive to perform for a mud formulation.

In some embodiments, to create the DoE functions, the additives may be varied. The mud then includes all the additives that the mud engineer adds, but also the debris from the drilling process that remains in the drilling fluid after the cuttings are removed, usually referred to as low gravity solids (LGS). Often, the LGS will be mostly clays of which bentonite (dominated by montmorillonite) is frequently the most rheologically active. Thus, in some embodiments, the DoE functions include LGS as an additive. The DoE function may include a standard mixture of minerals "OCMA" or other similar (see API 13A) as an additive for the LGS, in situations where the rock formation being drilled is unknown.

In some embodiments, creating and using the inversion of the functions to estimate the additives may include (i) allowing the inversion to estimate the LGS content and use that as input to calculate the other additives to add, or (ii) taking the direct LGS estimate as measured by the usual retort measurement.

A DoE matrix may significantly reduce the number of experiments performed. For example, a DoE matrix may collect experiments at specifically selected outer boundaries of the data set and at certain points in the middle. In this manner, for the example system described above with four levels of five tanks, a sample set of 34 experiments may be used to model the behavior of the system. This is a significant decrease from the total number of experiments of 1,024, and may be performed in a cost-effective and timely manner.

Using the results from the DoE experiments, the additive model generator 220 may determine mathematical relationships between each of the measurements and the components. In some embodiments, the additive model generator 220 may generate a polynomial fit, or generate a polynomial factor for each of the additives. In this manner, the additive model generator 220 may generate a forward-looking model that predicts the behavior of the drilling fluid based on the addition of quantities of the additives. Put another way, the additive model generator 220 may prepare an additive model that predicts the effect of the addition of a combination of additives to a drilling fluid.

The drilling fluid manager 218 may further include a model inverter 222. The model inverter 222 may perform an inversion function on the additive model generated by the additive model generator 220. The inverted additive model may return a result of a quantity amount based on the collected measurements. In this manner, the model inverter 222 may generate an inverted model that is used to calculate the amount of each additive to add based on measured parameters. The drilling fluid manager 218 includes a measurement collector 224. The measurement collector 224 may collect fluid parameter measurements regarding the drilling fluid. In some embodiments, the measurement collector 224 may receive measurements regarding the returned drilling fluid from one or more sensors or experiments. In some embodiments, the measurement collector 224 may include one or more sensors that directly measure the drilling fluid parameters.

The measurement collector 224 may compare the measurements of the drilling fluid parameters to the setpoint fluid properties. If one or more of the drilling fluid parameters are different than the same setpoint fluid properties by more than a threshold, the returned drilling fluid may be out of specification. In some embodiments, the threshold may be 1%, 2%, 3%, 4%, 5%, 6%, 7%, 8%, 9%, 10% of the setpoint fluid property. If the returned drilling fluid parameters are out of specification, then the drilling fluid manager 218 may use the difference and the inverted model to determine the amount of each additive to add to the returned drilling fluid to return the drilling fluid to the setpoint fluid parameters.

In some embodiments, the measurement collector 224 may receive a plurality of measurements. In some embodiments, the number of measurements may be the same as or greater than the number of independent variables from the DoE model. For example, the number of measurements may be the same as or greater than the number of distinct additives. This may allow the model inverter to develop a unique solution of the amount of each additive. In some embodiments, the measurements collected by the measurement collector may be unique measurements. A unique measurement may measure a unique property of the drilling fluid that is not captured by other measurements or other combinations of measurements. Put another way, a unique measurement may be independent or not reliant on any other collected property. Examples of unique measurements include shear stress at two different RPMs of the fluid, gel strength, solids component, emulsion component, and so forth. For example, a series (e.g., 2, 3, 4, or more) of shear stress measurements at different shear rates may be obtained (e.g., from a mud report). Each measurement may be an independent measurement that is made independently of the other measurements. The result of this series of measurements may include a curve that is well characterized by a model with 2 (Bingham) or possibly 3 (Herschel-Bulkley) parameters. In implementations where only two parameters (Bingham) need to be deduced, only two of the measurements may be necessary. Additional measurements may add accuracy, but may not be necessary, when the two measurements are orthogonal parameters.

In some embodiments, the drilling fluid manager 218 may further include an additive quantity manager 226. The additive quantity manager 226 may solve the inverted model generated by the model inverter 222 for the amount of additives that may be mixed with the returned drilling fluid to return it to the setpoint fluid parameters. For example, the additive quantity manager 226 may determine a difference between the measured fluid parameters and the setpoint fluid properties. Using the difference and the inverted model, the additive quantity manager 226 may solve the inverted model for the amount of each additive to add to the drilling fluid to return it to the setpoint fluid parameters.

In some embodiments, the additive quantity manager 226 may include a quantity optimizer 228. The quantity optimizer 228 may optimize the amount of each additive to add to the drilling fluid based on one or more external criteria or constraints. The constraints may be a non-fluid property. For example, a constraint may be cost, and the quantity optimizer 228 may optimize the amounts of additives to the lowest cost. In some examples, the constraint may be environmental, with environmental considerations limiting certain combinations or amounts of additives. In some examples, the constraint may be amount-based, such as an additive or additive combination that may lose effectiveness, precipitate out, or otherwise produce undesirable results at certain amounts or combination ratios. In some embodiments, the constraints used by the quantity optimizer 228 may contribute to the unique solution of the inverted model. In this manner, in combination with one or more constraints, a property number of a number of unique measurements may be less than an additive number of the number of additives.

In some embodiments, the drilling fluid manager 218 includes a fluid mixer 230. The fluid mixer 230 may cause the amounts of the additives determined by the additive quantity manager 226 to be added to the returned drilling fluid. For example, the additive tanks may have valves or other additive mechanisms, and the fluid mixer 230 may cause the valves to open to add the determined amount of each additive. In some examples, the fluid mixer 230 may send a message to a drilling operator or an engineer, instructing the drilling operator or engineer to add the amounts of the additives.

As discussed herein, the drilling fluid manager 218 may help to increase the accuracy of the determined amounts of the additives. This may help to maintain the drilling fluid within the threshold of the setpoint fluid properties. Furthermore, the drilling fluid manager may help to reduce the trained expertise at a drilling operation. For example, conventionally, a drilling operation may include a drilling fluid engineer to manage the properties of the drilling fluid. The drilling fluid manager 218 may allow for a drilling operation to operate without a drilling fluid engineer, or for a drilling fluid engineer to manage multiple operations. This may increase the operational efficiency of a drilling operation.

Each of the components 218-230 of the drilling fluid manager 218 can include software, hardware, or both. For example, the components 218-230 can include one or more instructions stored on a computer-readable storage medium and executable by processors of one or more computing devices, such as a client device or server device. When executed by the one or more processors, the computer-executable instructions of the drilling fluid manager 218 can cause the computing device(s) to perform the methods described herein. Alternatively, the components 218-230 can include hardware, such as a special-purpose processing device to perform a certain function or group of functions. Alternatively, the components 218-230 of the drilling fluid manager 218 can include a combination of computer-executable instructions and hardware.

Furthermore, the components 218-230 of the drilling fluid manager 218 may, for example, be implemented as one or more operating systems, as one or more stand-alone applications, as one or more modules of an application, as one or more plug-ins, as one or more library functions or functions that may be called by other applications, and/or as a cloud-computing model. Thus, the components 218-230 may be implemented as a stand-alone application, such as a desktop or mobile application. Furthermore, the components 218-230 may be implemented as one or more web-based applications hosted on a remote server. The components 218-230 may also be implemented in a suite of mobile device applications or "apps."

FIGS. 3-7, the corresponding text, and the examples provide a number of different methods, systems, devices, and computer-readable storage media of the drilling fluid manager 218. In addition to the foregoing, one or more embodiments can also be described in terms of flowcharts comprising acts for accomplishing a particular result, as shown in the figures. Each of the methods described may be performed with more or fewer acts. Further, the acts may be performed in differing orders. Additionally, the acts described herein may be repeated or performed in parallel with one another or parallel with different instances of the same or similar acts.

Figure 3:
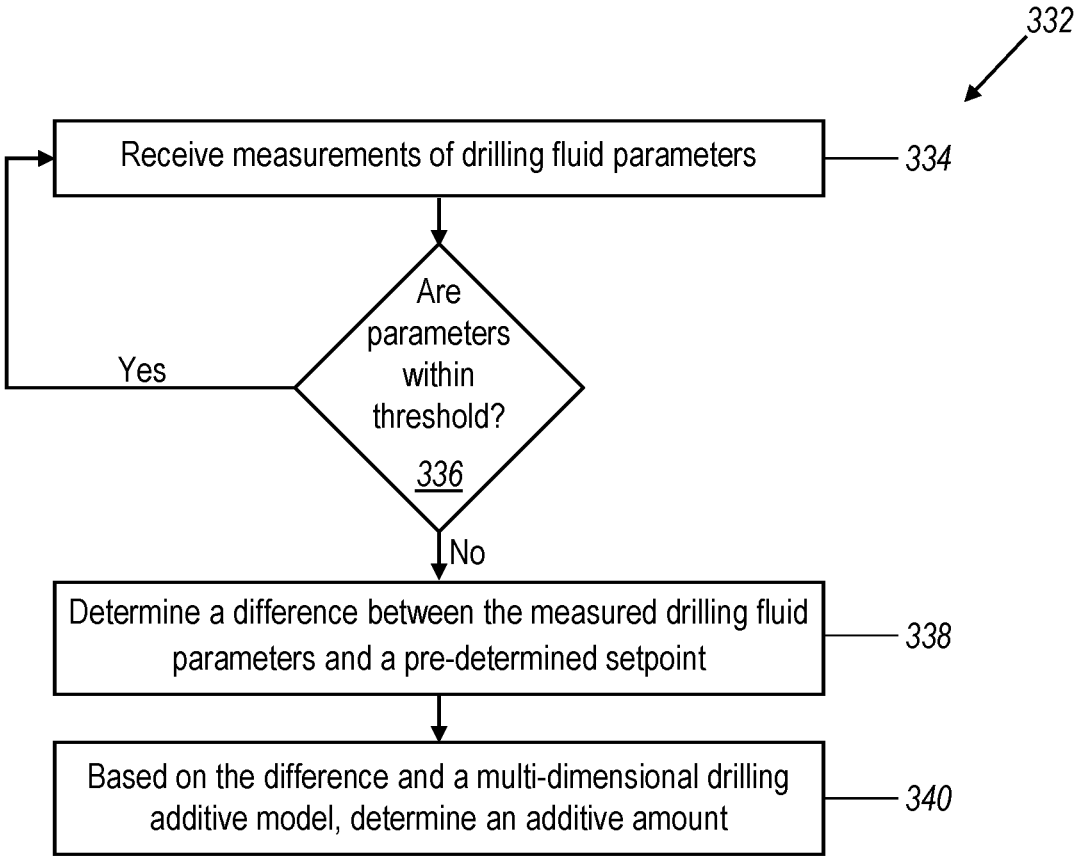
FIG. 3 is a flowchart of a method for managing a composition of a drilling fluid, according to at least one embodiment of the present disclosure.

As mentioned, FIG. 3 illustrates a flowchart of a series of acts for a method 332 for managing a drilling fluid composition in accordance with one or more embodiments. While FIG. 3 illustrates acts according to one embodiment, alternative embodiments may omit, add to, reorder, and/or modify any of the acts shown in FIG. 3. The acts of FIG. 3 can be performed as part of a method. Alternatively, a computer-readable storage medium (or set of computer-readable storage media) can include instructions that, when executed by one or more processors, cause a computing device to perform the acts of FIG. 3. In some embodiments, a system can perform the acts of FIG. 3.

In some embodiments, a drilling fluid manager may receive measurements of drilling fluid parameters of a drilling fluid at 334. As discussed herein, the drilling fluid manager may receive as many or more measurements of the drilling fluid parameters as the drilling system includes different additives. The drilling fluid manager may compare the measurements to setpoint fluid properties. The drilling fluid manager may determine 336 whether the measured parameters are within a pre-determined threshold of the setpoint fluid property. If the measured parameters are within the threshold, then the drilling fluid manager may continue to monitor the measured drilling fluid parameters until the parameters are outside of the threshold.

If the measured parameters are not within the threshold (e.g., if the measured parameters are outside of a threshold of the setpoint fluid properties) then the drilling fluid manager may determine a magnitude of a difference between the measured drilling fluid parameters and the pre-determined setpoint at 338. Based on the difference and an additive model, the drilling fluid manager may then determine an additive amount for each of the additives in the drilling system at 340. In some embodiments, the amount of the additive may be added to the drilling fluid. For example, the drilling fluid manager may instruct one or more valves or other control systems to automatically add the additive to the drilling fluid and mix them together. In some examples, the drilling fluid manager may provide an instruction to a drilling fluid engineer or other drilling operator to add the amounts of the additive to the drilling fluid.

Figure 4:
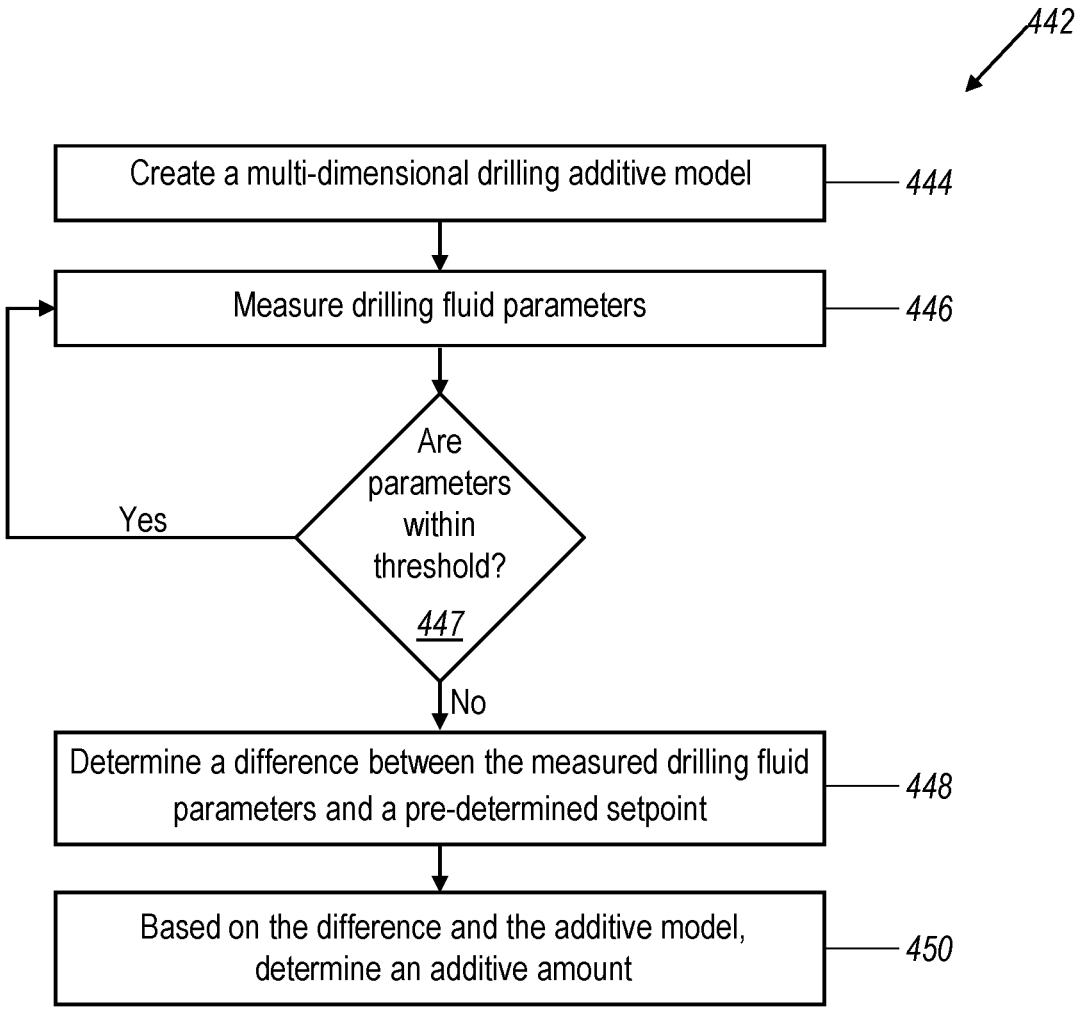
FIG. 4 is a flowchart of a method for managing a composition of a drilling fluid, according to at least one embodiment of the present disclosure.

As mentioned, FIG. 4 illustrates a flowchart of a series of acts for a method 442 for managing a drilling fluid composition in accordance with one or more embodiments. While FIG. 4 illustrates acts according to one embodiment, alternative embodiments may omit, add to, reorder, and/or modify any of the acts shown in FIG. 4. The acts of FIG. 4 can be performed as part of a method. Alternatively, a computer-readable storage medium (or set of computer-readable storage media) can include instructions that, when executed by one or more processors, cause a computing device to perform the acts of FIG. 4. In some embodiments, a system can perform the acts of FIG. 4.

A drilling fluid manager may create a multi-dimensional drilling additive model at 444. As discussed herein, the drilling fluid manager may create an additive model using a DoE matrix. The DoE matrix may provide interpolations of the effects and synergies of a plurality of drilling fluid additives on drilling fluid parameters. In some embodiments, creating the DoE matrix may include performing one or more experiments on a drilling fluid using different combinations of additives.

In some embodiments, the DoE matrix may be developed with no knowledge of the base drilling fluid formulation. For example, the DoE matrix may simply determine how a combination of additive amounts changes the measured fluid parameters. The DoE matrix experiments may be performed on a generic drilling fluid using different combinations of additive amounts. In this manner, multiple drilling operations at multiple wellbores, having the same combination of additives, may use the DoE matrix, even if they have different base formulations. This may help to increase the efficiency and ease-of-use of the drilling fluid manager.

In some embodiments, the drilling fluid manager may create or prepare the additive model before drilling operations commence. Because the DoE matrix may be developed based on experiments on a generic drilling fluid, the DoE matrix may not be developed for each particular drilling fluid at a specific wellbore. This may help to reduce the amount of work and experiments performed prior to commencing drilling activities.

In some embodiments, the drilling fluid manager may measure drilling fluid parameters, or receive measurements of drilling fluid parameters at 446. In some embodiments, the drilling fluid manager may receive the measurements before drilling activities have commenced. For example, the measurements may be performed on the drilling fluid to be used at a wellbore to see if the drilling fluid is within the setpoint fluid properties after it has been mixed. In some embodiments, the drilling fluid manager may measure the drilling fluid parameters or receive the drilling fluid parameters after starting drilling operations. For example, the drilling fluid manager may measure the drilling fluid parameters after the drilling fluid has circulated through the wellbore and returned to the surface.

After receiving the measured drilling fluid parameters, the drilling fluid manager may determine whether the measured parameters are within a threshold of pre-determined setpoint fluid properties at 447. If the measured parameters are within the threshold, the drilling fluid manager may continue to monitor and measure the drilling fluid parameters until the measured drilling fluid parameters are outside of the threshold of the setpoint fluid properties.

If the measured parameters are outside of the threshold, then the drilling fluid manager may determine a difference between the measured drilling fluid parameters and the setpoint fluid properties at 448. Based on the difference and the additive model, the drilling fluid manager may determine an additive amount for each of the additives at 450.

Figure 5:
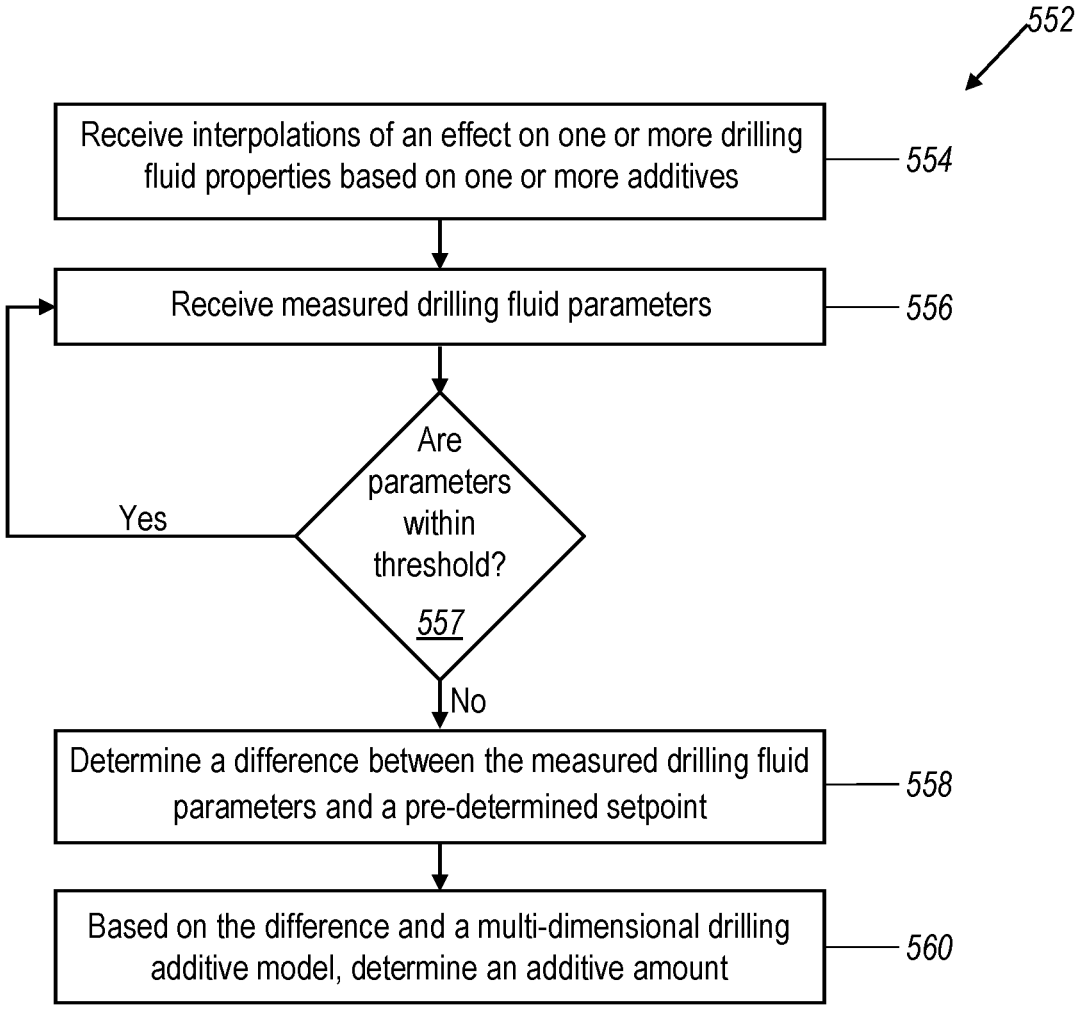
FIG. 5 is a flowchart of a method for managing a composition of a drilling fluid, according to at least one embodiment of the present disclosure.

As mentioned, FIG. 5 illustrates a flowchart of a series of acts for a method 552 for managing a drilling fluid composition in accordance with one or more embodiments. While FIG. 5 illustrates acts according to one embodiment, alternative embodiments may omit, add to, reorder, and/or modify any of the acts shown in FIG. 5. The acts of FIG. 5 can be performed as part of a method. Alternatively, a computer-readable storage medium (or set of computer-readable storage media) can include instructions that, when executed by one or more processors, cause a computing device to perform the acts of FIG. 5. In some embodiments, a system can perform the acts of FIG. 5.

A drilling fluid manager may receive interpolations of an effect on one or more drilling fluid properties based on one or more additives at 554. In some embodiments, the interpolations may be based off of a multi-dimensional drilling fluid additive model developed for the set of additives. In some embodiments, the interpolations may be forward looking, and may predict the change in fluid properties based on the added amounts of the additives. In some embodiments, the interpolations may be rearward looking, and may predict the amount of additive to add based on a desired change in a property.

In some embodiments, the drilling fluid manager may receive measurements of drilling fluid parameters at 556. In some embodiments, the drilling fluid manager may receive the measurements before drilling activities have commenced. For example, the measurements may be performed on the drilling fluid to be used at a wellbore to see if the drilling fluid is within the setpoint fluid properties after it has been mixed. In some embodiments, the drilling fluid manager may receive the drilling fluid parameters after starting drilling operations. For example, the drilling fluid manager may receive drilling fluid parameters after the drilling fluid has circulated through the wellbore and returned to the surface.

After receiving the measured drilling fluid parameters, the drilling fluid manager may determine whether the measured parameters are within a threshold of pre-determined setpoint fluid properties at 557. If the measured parameters are within the threshold, the drilling fluid manager may continue to monitor the measured drilling fluid parameters until the measured drilling fluid parameters are outside of the threshold of the setpoint fluid properties.

If the measured parameters are outside of the threshold, then the drilling fluid manager may determine a difference between the measured drilling fluid parameters and the setpoint fluid properties at 558. Based on the difference and the additive model, the drilling fluid manager may determine an additive amount for each of the additives at 560.

Figure 6:
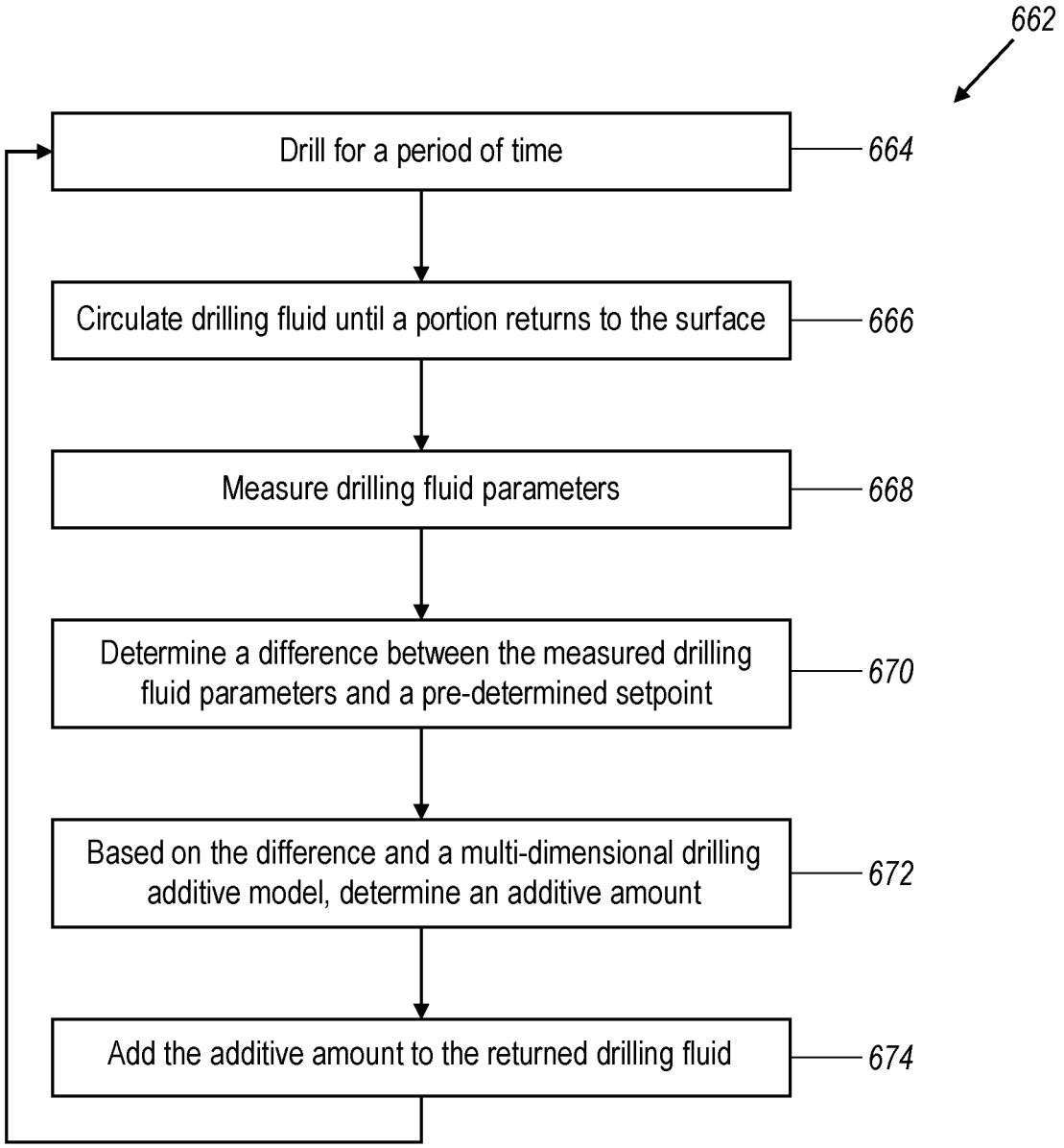
FIG. 6 is a flowchart of a method for managing a composition of a drilling fluid, according to at least one embodiment of the present disclosure.

As mentioned, FIG. 6 illustrates a flowchart of a series of acts for a method 662 for managing a drilling fluid composition in accordance with one or more embodiments. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable storage medium (or set of computer-readable storage media) can include instructions that, when executed by one or more processors, cause a computing device to perform the acts of FIG. 6. In some embodiments, a system can perform the acts of FIG. 6.

The method 662 may include drilling for a period of time at 664. Put another way, the method 662 may occur while performing drilling activities. While drilling, the drilling system may circulate drilling fluid through the wellbore until a portion of the drilling fluid returns to the surface location at 666. For example, drilling fluid may be circulated into the drill string while drilling, pass through the drill string to the wellbore bottom, and pass through the annulus between the drill string and the formation, and pass out of the wellbore to be deposited in a mud pit.

When the drilling fluid returns to the surface, the drilling fluid parameters of the drilling fluid may be measured at 668. As discussed herein, the properties of the drilling fluid may change based on the addition of cuttings and other material encountered while drilling. A drilling fluid manager may determine a difference between the measured drilling fluid parameters and pre-determined setpoint fluid properties at 670. Based on the difference and an additive model, the drilling fluid manager may determine an additive amount of a set of additives at 672. The method 662 may then include adding the additive amount of the additives to the returned drilling fluid. This may cause the parameters of the returned drilling fluid to return to within the threshold of the setpoint fluid properties.

In some embodiments, after adding the additives to the returned drilling fluid, the re-mixed returned drilling fluid may be circulated through the wellbore again, and the method 662 may be repeated indefinitely. For example, after adding the additive to the returned drilling fluid, the drilling operation may continue to drill and circulate the re-mixed drilling fluid for a second period of time. When the re-mixed drilling fluid is returned to the surface, the drilling fluid parameters may be measured and any differences between the measured fluid parameters used to determine additional additive amounts of the various additives.

Figure 7:
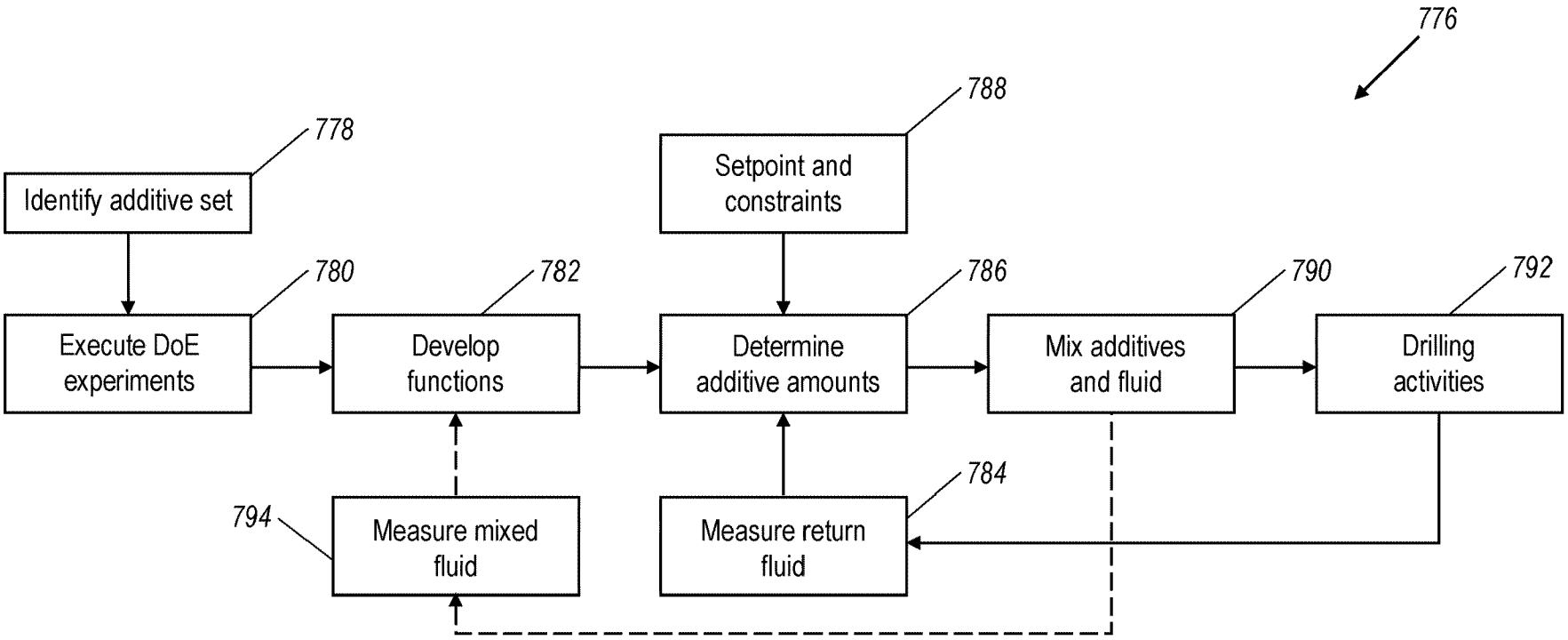
FIG. 7 is a flowchart of a method for managing a composition of a drilling fluid, according to at least one embodiment of the present disclosure.

As mentioned, FIG. 7 illustrates a flowchart of a series of acts for a method 776 for managing a drilling fluid composition in accordance with one or more embodiments. While FIG. 7 illustrates acts according to one embodiment, alternative embodiments may omit, add to, reorder, and/or modify any of the acts shown in FIG. 7. The acts of FIG. 7 can be performed as part of a method. Alternatively, a computer-readable storage medium (or set of computer-readable storage media) can include instructions that, when executed by one or more processors, cause a computing device to perform the acts of FIG. 7. In some embodiments, a system can perform the acts of FIG. 7.

In some embodiments, a drilling fluid manager may identify an additive set for a particular wellbore or set of wellbores at 778. The additive set may be identified based on availability of additives, previously used additives, cost-effectiveness of additives, any other reason, and combinations thereof. Using the additive set, the drilling fluid manager may execute DoE experiments for a drilling fluid at 780.

As discussed herein, the DoE experiments may be used to develop additive amount functions at 782. The additive amount functions may include interpolation functions, or forward-looking functions, which determine the change in a fluid property based on the addition of a combination of additives. In some embodiments, the additive amount functions may include an inverted interpolation function, or rearward looking functions, which determine a combination of additive amounts for a given change in a fluid property.

During drilling operations, the drilling fluid manager may measure drilling fluid parameters of a returned drilling fluid at 784. Using the measured drilling parameters and the developed functions, including the inverted interpolation function, the drilling fluid manager may determine the additive amounts of the additives to place the returned drilling fluid within a threshold of setpoint drilling properties at 786. In some embodiments, as discussed herein, the additive amounts may be determined using provided setpoint drilling properties and one or more optimization constraints at 788. For example, determining the additive amounts may include performing an optimization function based on one or more constraints, such as cost. The additives may then be added to the drilling fluid and mixed at 790. The mixed drilling fluid may then be used and circulated during further drilling activities at 792.

In some embodiments, after the drilling fluid mixed with the additives has been circulated through the wellbore and returned to the surface, the returned drilling fluid may be measured again at 784. The amount of additives to place the returned drilling fluid within the setpoint drilling properties may be determined again, and the additives mixed. This process may be repeated indefinitely throughout the drilling operation.

In some embodiments, the mixed fluid may be measured before it is used during drilling activities at 794. The measured fluid, and the additive amounts, may then be added to the DoE matrix. This may help to refine the DoE matrix by adding another data point. The refined DoE matrix may then be used to further develop the functions at 782. As the predictive functions are further developed, they may become more representative of the effect of the additives on the drilling properties.

Figure 8:
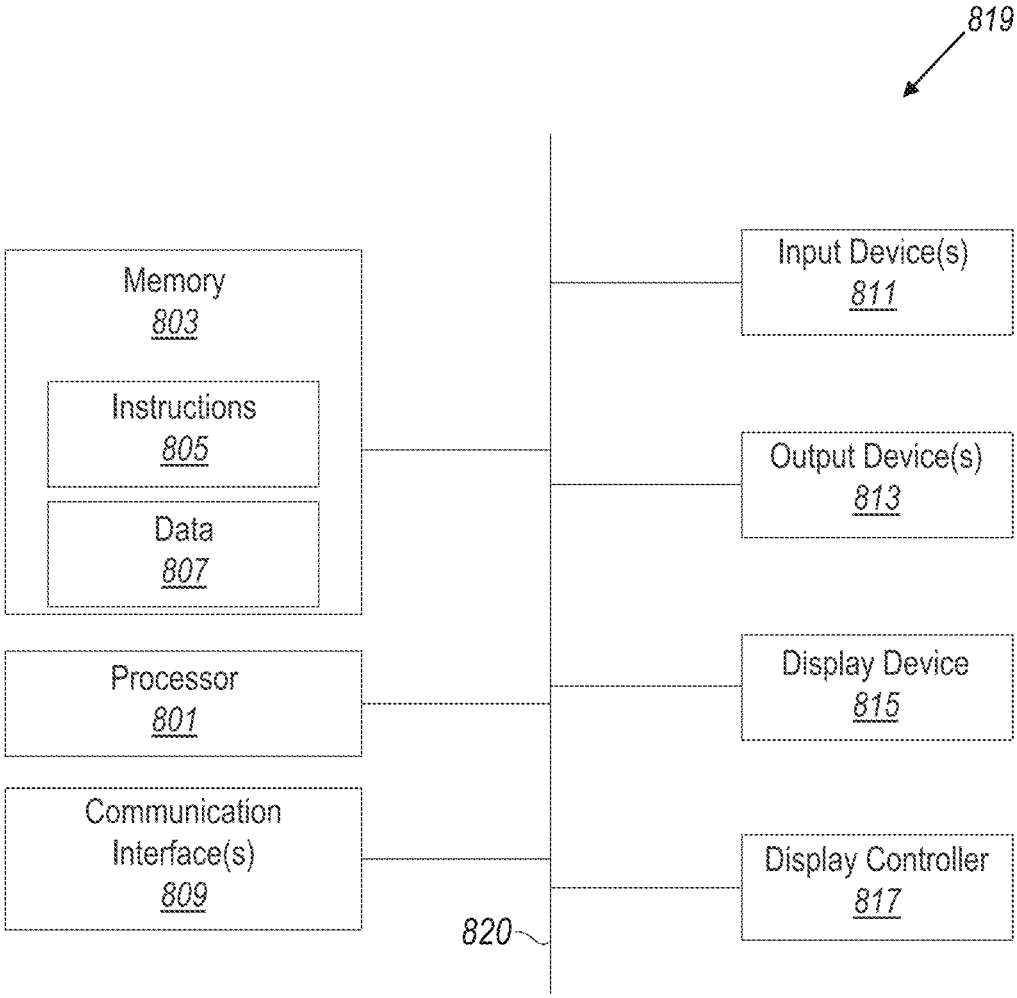
FIG. 8 is a representation of a computing system for use in aspects of the present disclosure, according to at least one embodiment of the present disclosure.

FIG. 8 illustrates certain components that may be included within a computer system 819. One or more computer systems 819 may be used to implement the various devices, components, and systems described herein.

The computer system 819 includes a processor 801. The processor 801 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 801 may be referred to as a central processing unit (CPU). Although just a single processor 801 is shown in the computer system 819 of FIG. 8, in an alternative configuration, a combination of processors (e.g., an ARM and DSP) could be used.

The computer system 819 also includes memory 803 in electronic communication with the processor 801. The memory 803 may be any electronic component capable of storing or carrying electronic information. For example, the memory 803 may be computer readable media (including devices) embodied as computer-readable storage media, computer-readable transmission media, or combinations thereof. Computer-readable media can be any available media that can be accessed by a general purpose or special purpose computer system. Computer-readable media that store computer-executable instructions are computer-readable storage media. Computer-readable media that carry computer-executable instructions are transmission media. Thus, by way of example, and not limitation, embodiments of the disclosure can comprise at least two distinctly different kinds of computer-readable media, namely computer-readable storage media (devices) and computer-readable transmission media.

As used herein, computer-readable storage media may include random access memory (RAM), read-only memory (ROM), magnetic storage media, compact disc read-only memory (CD ROM), flash memory devices, solid state drives (SSD), phase-change memory (PCM), on-board memory included with the processor, erasable programmable read-only memory (EPROM), electrically erasable programmable read-only memory (EEPROM) memory, registers, other types of memory, other optical disc storage, or any other medium which can be used to store desired program code means in the form of computer-executable instructions or data structures and which can be accessed by a general purpose or special purpose computer. Computer-readable transmission media, in contrast, includes media that carries or transmits electronic information. For instance, computer-readable transmission media can include carrier waves or wireless links.

The memory 803 may be local or remote relative to other components of the computing system 819, including relative to the processor 801. The memory 803 may also be distributed between multiple local and/or remote components or locations. Instructions 805 and data 807 may be stored or carried in the memory 803. The instructions 805 may be executable by the processor 801 to implement some or all of the functionality disclosed herein. Executing the instructions 805 may involve the use of the data 807 that is in the memory 803. Any of the various examples of modules and components described herein may be implemented, partially or wholly, as instructions 805 in the memory 803 and executed by the processor 801. Any of the various examples of data described herein may be among the data 807 that is in the memory 803 and used during execution of the instructions 805 by the processor 801.

A computer system 819 may also include one or more communication interfaces 809 for communicating with other electronic devices. The communication interface(s) 809 may be based on wired communication technology, wireless communication technology, or both. Some examples of communication interfaces 809 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 819 may also include one or more input devices 811 and one or more output devices 813. Some examples of input devices 811 include a keyboard, mouse, microphone, remote control device, button, joystick, trackball, touchpad, and lightpen. Some examples of output devices 813 include a speaker and a printer. One specific type of output device that is typically included in a computer system 819 is a display device 815. Display devices 815 used with embodiments disclosed herein may utilize any suitable image projection technology, such as liquid crystal display (LCD), light-emitting diode (LED), gas plasma, electroluminescence, or the like. A display controller 817 may also be provided, for converting data 807 stored in the memory 803 into text, graphics, and/or moving images (as appropriate) shown on the display device 815.

The various components of the computer system 819 may be coupled together by one or more buses, which may include a power bus, a control signal bus, a status signal bus, a data bus, etc. For the sake of clarity, the various buses are illustrated in FIG. 8 as a bus system 820. The embodiments of the drilling fluid manager have been primarily described with reference to wellbore drilling operations; the drilling fluid manager described herein may be used in applications other than the drilling of a wellbore. In other embodiments, drilling fluid managers according to the present disclosure may be used outside a wellbore or other downhole environment used for the exploration or production of natural resources. For instance, drilling fluid managers of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for managing a drilling fluid composition, comprising:

receiving an inversion of a multi-dimensional drilling additive model, wherein the multi- dimensional drilling additive model correlates an addition of a plurality of additives to a drilling fluid to an effect on a plurality of drilling fluid properties, wherein the multi-dimensional drilling additive model has a variable quantity of variables that is equal to an additive quantity of the plurality of additives, wherein the inversion generates an additive recommendation based on a measurement of the plurality of drilling fluid properties;

drilling for a first period of time;

circulating the drilling fluid from a surface location to a wellbore bottom for the first period of time until at least a portion of the drilling fluid is returned to the surface location;

after the portion of the drilling fluid is returned to the surface location, receiving a plurality of measurements of the plurality of drilling fluid properties, wherein a measurement quantity of the plurality of measurements is equal to or greater than the variable quantity;

determining a difference in the measurement of the plurality of drilling fluid properties from predetermined setpoint fluid properties, wherein the predetermined setpoint fluid properties include the drilling fluid composition for use during operation;

applying the inversion to the plurality of measurements and the difference to determine an amount of the plurality of additives to return the plurality of drilling fluid properties to within a threshold of the predetermined setpoint fluid properties based on the inversion and the difference; and adding the amount of the plurality of additives to the drilling fluid.

2. The method of claim 1, wherein the measurement is a first measurement, the difference is a first difference, and the amount is a first amount, and further comprising:

receiving a second measurement of the plurality of drilling fluid properties;

determining a second difference in the second measurement of the plurality of drilling fluid properties and the predetermined setpoint fluid properties; and determining a second amount of the plurality of additives to return the plurality of drilling fluid properties to within the threshold of the predetermined setpoint fluid properties based on the inversion and the second difference.

3. The method of claim 2, further comprising refining the inversion based on the first amount and the second measurement.

4. The method of claim 1, further comprising:

drilling for a second period of time after adding the amount of the plurality of additives;

circulating the drilling fluid from the surface location to the wellbore bottom for the second period of time until at least a second portion of the drilling fluid including the amount of the plurality of additives is returned to the surface location; and receiving a second measurement of the plurality of drilling fluid properties after the second portion of the drilling fluid is returned to the surface location.

5. The method of claim 1, further comprising optimizing the amount of the plurality of additives with at least one of a Monte Carlo simulation or a steepest descent model.

6. A system, comprising:

a processor; and memory, the memory including instructions which, when accessed by the processor, cause the processor to:

receive an inversion of a multi-dimensional drilling additive model, wherein the multi-dimensional drilling additive model correlates an addition of a plurality of additives to a drilling fluid to an effect on a plurality of drilling fluid properties, wherein the multi- dimensional drilling additive model has a variable quantity of variables that is equal to an additive quantity of the plurality of additives, wherein the inversion generates an additive recommendation based on a measurement of the plurality of drilling fluid properties;

drill for a first period of time;

circulate the drilling fluid from a surface location to a wellbore bottom for the first period of time until at least a portion of the drilling fluid is returned to the surface location;

after the portion of the drilling fluid is returned to the surface location, receive a plurality of measurements of the plurality of drilling fluid properties, wherein a measurement quantity of the plurality of measurements is equal to or greater than the variable quantity;

determine a difference in the measurement of the plurality of drilling fluid properties from predetermined setpoint fluid properties, wherein the predetermined setpoint fluid properties include a drilling fluid composition for use during operation;

apply the inversion to the plurality of measurements and the difference to determine an amount of the plurality of additives to return the plurality of drilling fluid properties to within a threshold of the predetermined setpoint fluid properties based on the inversion and the difference; and add the amount of the plurality of additives to the drilling fluid.

7. The system of claim 6, wherein the measurement is a first measurement, the difference is a first difference, and the amount is a first amount, and the memory includes further instructions which, when accessed by the processor, further cause the processor to:

receive a second measurement of the plurality of drilling fluid properties;

determine a second difference in the second measurement of the plurality of drilling fluid properties and the predetermined setpoint fluid properties; and determine a second amount of the plurality of additives to return the plurality of drilling fluid properties to within the threshold of the predetermined setpoint fluid properties based on the inversion and the second difference.

8. The system of claim 7, wherein the memory includes further instructions which, when accessed by the processor, further cause the processor to refine the inversion based on the first amount and the second measurement.

9. The system of claim 6, wherein the memory includes further instructions which, when accessed by the processor, further cause the processor to:

drill for a second period of time after adding the amount of the plurality of additives;

circulate the drilling fluid from the surface location to the wellbore bottom for the second period of time until at least a second portion of the drilling fluid including the amount of the plurality of additives is returned to the surface location; and receive a second measurement of the plurality of drilling fluid properties after the second portion of the drilling fluid is returned to the surface location.

10. The system of claim 6, wherein the memory includes further instructions which, when accessed by the processor, further cause the processor to optimize the amount of the plurality of additives with at least one of a Monte Carlo simulation or a steepest descent model.

11. A method for managing a drilling fluid composition of a drilling fluid, comprising:

creating a multi-dimensional drilling additive model of an effect of a plurality of additives on a plurality of drilling fluid properties, wherein the multi-dimensional drilling additive model has a variable quantity of variables that is equal to an additive quantity of the plurality of additives;

inverting the multi-dimensional drilling additive model resulting in an inversion, wherein the inversion generates an additive recommendation based on a measurement of the plurality of drilling fluid properties;

after circulating the drilling fluid from a surface location to a wellbore bottom for a first period of time, measuring a plurality of measurements of the plurality of drilling fluid properties of the drilling fluid, wherein a measurement quantity of the plurality of measurements is equal to or greater than the variable quantity;

determining a difference between the plurality of measurements and predetermined setpoint fluid properties, wherein the predetermined setpoint fluid properties include the drilling fluid composition for use during operation;

applying the inversion to the plurality of measurements and the difference to determine an additive amount for each of the plurality of additives; and adding the additive amount of each of the plurality of additives to the drilling fluid to return the plurality of drilling fluid properties to within a threshold of the predetermined setpoint fluid properties.

12. The method of claim 11, wherein creating the multi-dimensional drilling additive model includes generating a design of experiment matrix.

13. The method of claim 11, further comprising performing an optimization of the multi-dimensional drilling additive model to determine the additive amount of each of the plurality of additives.

14. The method of claim 13, wherein the performing the optimization includes accounting for one or more external constraints.

15. The method of claim 13, wherein performing the optimization includes performing one or more of a Monte Carlo simulation or steepest descent method.

16. The method of claim 11, wherein measuring the plurality of measurements includes measuring a property number of the plurality of drilling fluid properties that is greater than an additive number of the plurality of additives.

17. The method of claim 11, wherein creating the multi-dimensional drilling additive model includes creating the multi-dimensional drilling additive model with no knowledge of a base drilling fluid formulation.

* * * * *